US005818148A

United States Patent [19]

Shiomi

[11] Patent Number: 5,818,148

[45] Date of Patent: Oct. 6, 1998

[54] ELECTROMECHANICAL SWITCH

[75] Inventor: Hiromu Shiomi, Itami, Japan

[73] Assignee: Sumitomo Electric Industries, Ltd., Osaka, Japan

[21] Appl. No.: 812,076

[22] Filed: Mar. 6, 1997

[30] Foreign Application Priority Data

Mar. 7, 1996 [JP] Japan ..... 8-080772

[51] Int. Cl.[6] ..... H01H 57/00; H01H 15/04; H01H 15/06; H01H 15/10

[52] U.S. Cl. ..... 310/328; 310/309; 200/259; 200/181

[58] Field of Search ..... 310/309, 328; 200/33 D, 181, 258–261

[56] References Cited

U.S. PATENT DOCUMENTS

| | | | |
|---|---|---|---|
| 2,885,509 | 5/1959 | Diesel et al. | 200/87 |
| 3,365,592 | 1/1968 | Knautwald et al. | 310/328 |
| 4,013,851 | 3/1977 | Abbondante | 200/86 R |
| 4,065,677 | 12/1977 | Micheron et al. | 200/181 |
| 4,145,586 | 3/1979 | Swann | 200/67 G |
| 4,283,611 | 8/1981 | Bull | 200/252 |
| 4,754,185 | 6/1988 | Gabriel et al. | 310/309 |
| 4,783,610 | 11/1988 | Asano | 310/328 |
| 5,239,222 | 8/1993 | Higuchi et al. | 310/309 |
| 5,359,252 | 10/1994 | Swift et al. | 310/328 |
| 5,386,400 | 1/1995 | Nakayama et al. | 369/13 |
| 5,448,124 | 9/1995 | Higuchi et al. | 310/309 |
| 5,534,740 | 7/1996 | Higuchi et al. | 310/309 |
| 5,541,465 | 7/1996 | Higuchi et al. | 310/309 |
| 5,576,589 | 11/1996 | Dreifus et al. | 310/313 A |

FOREIGN PATENT DOCUMENTS

| | | | |
|---|---|---|---|
| 0 584 479 A1 | 3/1994 | European Pat. Off. | 310/309 |
| 3-65083 | 3/1991 | Japan | 310/309 |
| 5-184162 | 12/1991 | Japan | 310/309 |
| 4-271284 | 9/1992 | Japan | 310/309 |
| 5-184162 | 7/1993 | Japan | 310/309 |

OTHER PUBLICATIONS

IEEE Electron Device Letters, vol. 10 No. 10, Oct. 1989 "Power Semiconductor Device Figure of Merit for High-Frequency Applications" B.Jayant Baliga, pp. 455–457.

IEEE Spectrum, Jul. 1995 Advanced Technology "Power ICS in the Saddle" B. Jayant Baliga, pp. 34–49.

*Primary Examiner*—Thomas M. Dougherty

*Attorney, Agent, or Firm*—Cushman Darby & Cushman IP Group of Pillsbury Madison & Sutro LLP

[57] ABSTRACT

A mechanical switch having two contacting sliding plates which have conductive parts periodically dispersed in an insulating background in a spatial period and a current assembling member for gathering currents from the conductive parts, and a driving device for reciprocating two sliding plates in parallel to the surface relatively by about half a period. The driving device cuts or leads a current from one sliding plate to the other by displacing the sliding plates. Parallel movement of the plates suppresses the occurrence of arc discharge in shutting a big current. The short stroke of the displacement gives high speed switching to the device.

17 Claims, 4 Drawing Sheets

ELECTROMECHANICAL SWITCH

This application claims a priority based on Japanese Patent Application No. 80772/1996 filed Mar. 7, 1996.

FIELD OF THE TECHNOLOGY

This invention relates to an electric switch, in particular, to a high power switch which can cut or lead a large electric current. Especially, this invention aims at an electromechanical switch which excels in a high speed operation, a high resistance in the off-state and a low resistance in the on-state.

BACKGROUND OF THE INVENTION

Electric switches are roughly classified into two categories. One is mechanical switches and the other is semiconductor switches. The parameters which rule the conduction of a current are given by the following equation $$I=Aen\mu V/d \quad (1),$$

where I is a current, A is a sectional area in which the current flows, n is a carrier density, $\mu$ is a mobility of carriers, V is an applied voltage and d is a distance between two electrodes. Mechanical switches are the switches which control the current by changing the area A in which the current flows. Semiconductor switches are the switches which control the current by changing the carrier density.

Mechanical switches carry out the switching operation by bringing the conducting parts (electrodes) which lead electric currents in contact or separating the conducting parts from each other. When the switch is in the closed state, a current flows from one conducting part to the other conducting part. In the closed state (on-state), the resistance is only a small contact resistance between the contacting electrodes. Such a small resistance enables the mechanical switch to carry a big current without a large Joule heat loss. In the open state (off-state), two electrodes are separated by several millimeters or more in the air. The large distance between the electrodes allows the mechanical switch to apply a high voltage.

On the contrary, semiconductor switches are closed or opened by controlling the density of carriers. The carrier density is changed by controlling the width of a depletion layer of a pn-junction, a Schottky junction or an MIS junction. The controlling of the depletion layer excels in speed. Thus, semiconductor switches are suitable for high speed switching. The allowable voltage is restricted by reason of avoiding the breakdown of the insulating state in the semiconductor switches. The electric field applied at any region must be smaller than the insulator breakdown voltage of the semiconductor material.

For example, the insulator-breakdown voltage is $3\times10^5$ V/cm in silicon (Si). The breakdown voltage of several thousand volts requires hundreds of micrometers ($\mu$m) of thickness in silicon switching devices. Such a very thick layer would be useful for insulating in the open state (off-state) but would cause a serious problem in the closed state (on-state). In the on-state, a large current would flow in the thick layer. The large current and the high voltage would induce big Joule heat. A large amount of heat may break the semiconductor device. The requirement of avoiding the thermal breakdown restricts the allowable current in the closed state (on-state) to a small value. Thus, a low resistance in the on-state and a high endurance (breakdown) voltage in the off-state are required for semiconductor switches. Some trials have been done to make such semiconductor switches which satisfy the two conditions. For example, several new power semiconductor switching devices have been proposed by (1) Special Edition, "New Power semiconductor Devices", Transistor Technology, September, 1994, p198 (1994)

(2) B. J. Baliga, "Power semiconductor device figure of merit for high-frequency applications", IEEE Electron Device Lett., vol. 10, p455 (1989)

(3) B. J. Baliga, "Power ICs in the saddle", IEEE Spectrum, July, 1995, p34–49 (1995).

The development of power devices would attain the upper limits of the current at the on-time (on-time current or on-current) and the voltage at the off-time (off-time voltage or off-voltage) restricted by the property of the material. Then we could not make a switching device which exceeds the current density defined by the property of the silicon semiconductor material.

Since the limits of the on-time current and the off-time voltage cannot be raised by silicon semiconductor, some new semiconductors have been investigated as candidate materials of switching devices. For example, it has been proposed the power devices be made from semiconductor diamond or semiconductor SiC. Since these new materials excel in heat-resistance, diamond or SiC power devices would be perhaps able to go beyond the limit of silicon.

No switching devices of the new materials have been produced yet in practice. Even if diamond switching devices or SiC switching devices would be realized, the antinomy between the high off-voltage and the low on-resistance would annoy the switching devices made from semiconductor diamond or semiconductor silicon carbide (SiC). The switching devices based upon the new semiconductors would reach the upper limits of the off-voltage and the on-resistance in near future.

On the other hand, mechanical switches are generally capable of running a large current at the on-time and of insulating a high voltage at the off-time. A mechanical switch directly brings metal electrodes into contact or separates the electrodes. For example, the switch of a substation can break or lead a big current of tens of thousands of amperes (A) and a high voltage of tens of kilovolts (kV). The mechanical switch satisfies two requirements of the high breakdown voltage at the off-time and the low resistance at the on-time. Mechanical switches, however, are afflicted with a slow switching speed.

For example, it is difficult for a mechanical switch to turn on or turn off a current at a frequency of several kilohertzes (kHz). Another difficulty is an arc discharge which occurs between contact points when the switch cuts a big current. The current still keeps on flowing through the arc discharge after turning off the switch. Starting from a low voltage, the arc voltage rises up to the voltage of the power source. The arc current decreases and disappears when the arc voltage attains at the full voltage of the power source. The generation of the arc discharge retards the cut-off of the current. Besides the delay of the cut-off, the arc discharge often damages the contact points of the switch. The heat of the arc burns or melts the contact points. An arc-extinguishing plate is usually provided in the vicinity of the contacts for protecting the contacts from the arc discharge. The arc-extinguishing plate accelerates the extinction of the arc by cooling the arc. Improvements for annihilating the arc by the arc-extinguishing plate were suggested by;

(4) Japanese Patent Publication No. 7-82796(82796/'95), (5) Japanese Patent Publication No. 7-82797(82797/'95), (6) Japanese Patent Publication No. 7-82798(82798/'95), and (7) Japanese Patent Publication No. 7-87060(87060/'95).

Some of the contrivances tried to cool the arc by facilitating the arc-extinguishing plate to touch the arc. Another made an effort to extinguish the arc discharge in a short time by pulling and cooling the arc by an arc-absorption magnet. These contrivances protect the contact points from burning by annihilating the arc discharge in a short time. Nevertheless, the occurrence of the arc at the moment of turning the switch off is unavoidable because of the mechanical contact or separation of the electrodes.

(8) Japanese Patent Publication No. 7-82898(82898/'95) proposed a mechanical switch having metal contact points being in sliding contact with each other. Since the metal contact points are in sliding contact, this switch requires a small friction between the contact points and a small on-time resistance at the contacts. Thus, this type mechanical switches demand excellent sliding members and contact metals with low friction. Lead (Pb) or antimony (Sb) was adopted as the material of the contacts, since Pb and Sb have small friction coefficients. Pb and Sb are, however, poisons. To avoid poisonous materials, (8) employed another material to build the contact points of the mechanical switch. This material consists of copper and carbon as a basic component and thermohardening plastics, tar, metals or graphite as a binder. The basic component and the binder are mixed with each other. The binder must be a material which makes no alloy by reacting with the basic material. (8) reported that the contact points of low friction were built with unpoisonous materials.

Semiconductor switches and mechanical switches have counterbalancing advantages and disadvantages. Semiconductor switches are superior in the speed of response. Namely, the times of opening and shutting the circuit are short. The cut-off time is, in particular, short in semiconductor switches. Nevertheless, semiconductor switches are commonly annoyed at the low off-time voltage and the large on-time resistance. The large on-time resistance prevents the semiconductor switches from leading a big current due to a large heat generation. On the contrary, mechanical switches have an advantage of a low on-time resistance which allows a big current to flow without heat generation. The mechanical switches are plagued with the delay of the on-off transition due to the arc discharge following the cut-off of the contact points.

Any prior switches cannot satisfy all the three requirements;

(1) high off-time voltage, (2) low on-time contact resistance and (3) high speed switching.

A mechanical switch fails in high speed switching (3). A semiconductor switch is inferior in high off-time voltage (1) and low on-time contact resistance (2).

SUMMARY OF THE INVENTION

One purpose of the present invention is to provide a switch satisfying all the three requirements of high off-time voltage (1), low on-time contact resistance (2) and high speed switching (3). Another purpose of the present invention is to provide a switch which is immune from an arc discharge and the damage by the arc discharge. A further purpose is to provide a switch with a short cut-off time by suppressing the occurrence of an arc discharge. A still further purpose is to provide a switch capable of leading and cutting a big current.

The switch of the present invention has a first sliding plate having periodically-arranged conductive parts in insulating parts on a surface and a current assembling member leading to the superficial conductive parts; and a second sliding plate having periodically-arranged conductive parts with the same period in insulating parts on a surface and a current assembling member leading to the conductive parts. The second sliding plate is in contact with the first sliding plate face to face and a driving device for displacing relatively the sliding plates by about half a period of the conductive parts. The driving device allows the two sliding plates to take two stable positions, and reciprocates the sliding plates between the two stable positions at a high speed. One position is an on-position which brings the conductive parts on the first sliding plate to come into contact with the counterpart conductive parts of the second sliding plate. The other position is an off-position which makes the conductive parts on the first sliding plate to be in contact with the insulating parts of the second sliding plate.

The periodicity which can be developed on a surface is either one-dimensional periodicity or two-dimensional periodicity, because a surface has a two-dimensional space. In the case of the one-dimensional periodicity, the conductive parts become parallel stripes (D), and the insulating parts also become parallel stripes (Z). The period T is equal to a sum (D+Z). In the case of the two-dimensional periodicity, the conductive parts become dots or islands dispersed uniformly lengthwise and crosswise in an insulating background. The stripe type of conduction parts is more effective in leading a large current than the dot type of conduction parts. Thus the stripe type will be mainly explained in the following description. The dot type (two-dimensional symmetry), however, is also clarified as an alternative of the stripe type conduction parts occasionally.

In the case of the stripe type, the switch of the present invention has a first sliding plate having parallel conductive stripes and parallel insulating stripes by turns on a surface and a current assembling member leading to the conductive stripes, a second sliding plate having parallel conductive stripes and parallel insulating stripes on a surface, a current assembling member leading to the conductive stripes, the second sliding plate being in contact with the first sliding plate on the striped surfaces, and a driving device for displacing relatively the sliding plates in the direction parallel to the surface but not parallel to the stripes in the contact state. The spacings of neighboring conductive stripes are common in the first sliding plate and the second sliding plate. The driving device allows the two sliding plates to take two stable positions, and reciprocates the sliding plates between the two stable positions at a high speed.

One stable position is an on-position in which the conductive stripes of the first sliding plate are in contact with the counterpart conductive stripes of the second sliding plate, and the insulating stripes of the first sliding plate are in contact with the counterpart insulating stripes of the second sliding plate. The contacts of both sets of the conductive stripes allow a current to flow from the first sliding plate to the second sliding plate or vice versa. The other stable position is an off-position in which the conductive stripes of the first sliding plate are in contact with the counterpart insulating stripes of the second sliding plate, and the insulating stripes of the first sliding plate are in contact with the counterpart conductive stripes of the second sliding plate. The contacts of the conductive stripes to the insulating stripes forbid a current from flowing from the first sliding plate to the second sliding plate or vise versa. The distance between two stable positions is small enough to allow the driving device to displace the sliding plate in a very short time. The smallness of the distance enables the switching device to realize high speed switching. Since the motion of the driving device is parallel to the surfaces of the sliding plates, the plates slide on the counterparts. Since two sliding plates do not separate spatially, no arc discharge occurs. The motion is not necessarily vertical to the stripes. Only the motion parallel to the stripes is forbidden for the reciprocal motion of the plates. The driving device is, for example, a piezoelectric device, an electrostatic device or another micro-driving device which can induce a short range reciprocal motion.

"D" denotes the width of a conductive stripe. "Z" denotes the width of an insulating stripe. "M" is the total number of the conductive stripes. Then, there are M+1 insulating stripes and regions on each conductive plate. The width D of the conductive stripe is narrower than the width Z of the insulating stripe (D<Z). "L" denotes an effective length of the conductive stripes. If the lengths of two kinds of stripes are equal, an insulating stripe is a Z×L band, and a conductive stripe is a D×L band. Every pair of neighboring conductive stripes is intervened by an insulating stripe. A period of the stripes is (D+Z). The driving device relatively moves two sliding plates in a vertical direction by a definite distance "S" which is longer than D but shorter than Z (D<S<Z).

In the case of dot type conduction parts, the first sliding plate has conduction dots uniformly distributed in an insulating background with a period T. The second sliding plate also has conduction dots uniformly distributed in an insulating background with the same period T. The driving device relatively reciprocates the sliding plates in the x-direction or the y-direction between two stable points. Here, the x-axis and y-axis are orthogonal axes defined on the sliding plate. One stable point is an on-point which allows the dots of the first plate to come into contact with the dots of the second plate. The other stable point is an off-point which brings the dots of the first plate into contact with the insulating background of the second plate. The possibility of two-dimensional displacement of the sliding plates increases the freedom of switching action of the dot type.

[VARIATIONS OF SLIDING PLATES]

There are some variations of the sliding plates which are essential parts in the present invention.

1. INSULATOR-BURIED METAL TYPE

A first type of sliding plate is made on a metal plate by digging a plurality of parallel grooves on the metal plate and filling the grooves with an insulator in the case of the stripe type. The insulator-filling grooves play the role of insulating stripes. The metal surfaces become conducting stripes. Two sliding plates are overlapped face to face with the stripes in parallel. A driving device is mounted at an end of one of the sliding plates for reciprocating the counterpart sliding plate in the direction orthogonal to the stripes. An alternative is made by masking dots periodically with a resist, etching the background and filling the etched background with an insulating material.

2. INSULATING DIAMOND STRIPE TYPE

A second type of sliding plate is made on a metal substrate by depositing an insulating diamond film on a flat metal substrate, etching the diamond film in stripes to form parallel grooves till the metal reveals at the bottoms of the grooves, and growing conductive diamond selectively on the grooves. The conductive diamond stripes and the insulating diamond stripes are formed by turns on the metal substrate. Both the conductive stripes and the insulating stripes are made from deposited diamond. A dot-type one can also be produced by depositing an insulating diamond film overall on a metal substrate, etching the diamond film in dots, and filling the dots with conductive diamond.

3. CONDUCTIVE DIAMOND STRIPE TYPE

A third type of sliding plate is made on a metal substrate by growing a conductive (e.g. boron-doped) diamond film on the metal substrate, etching the diamond film in stripes to form parallel grooves till the metal reveals at the bottoms of the grooves, and growing insulating diamond in the grooves. Thus, the conductive diamond stripes and the insulating diamond stripes are produced on the flat metal substrate. Deposited diamond forms both the conductive stripes and the insulating stripes. A dot-type can be made by depositing a conductive film on a metal substrate, masking dots periodically determined on a diamond film, etching the diamond film except the dots, and filling the background with insulating diamond.

4. DOPED DIAMOND STRIPE TYPE

A fourth type of sliding plate is made on a metal substrate by growing an insulating diamond on the metal substrate, masking the diamond in stripes by a resist pattern, doping boron atoms into the diamond film by ion implantation or so on till the depth of the metal surface. The boron-doped parts become conductive stripes. The undoped parts which had been masked become insulating stripes.

Among the four types, type 1 is composed of different materials for the conductive parts and the insulating parts. The other types 2 to 4 have a common material both for conductive parts and insulating parts.

The materials of the contact surfaces are classified into two categories. One is a homogeneous contact surface having the same material both for the conductive portions and for insulating portions. The other a is heterogeneous contact surface having different materials for the conduction parts and the insulating background. Type 1 is heterogeneous one. Types 2 to 3 are homogeneous ones.

The advantages of the present invention are as follows;

(1) The switch of the present invention turns on and turns off a current by gliding two sliding plates having conductive parts and an insulating background. An assembly of a plenty of small conducting parts accomplishes an effectively wide conductive area which enables the switch to turn on and turn off a large current.

(2) The driving device displaces two sliding plates in the direction parallel to the surfaces instead of the direction vertical to the surfaces. The gap between the conductive members in the open state is not filled with air but filled with insulating members. Thus, arc discharge is effectively suppressed by the insulators. An arc usually originates from the air gap between the switch terminals in the open state.

(3) The driving device of gliding the plates can be built with a set of a motor, a reduction gear and a crank. The stroke of the displacement is so short that the speed of switching is very high. If the driving device is an electric static actuator or a piezoelectric actuator, the electromechanical switch realizes a far higher speed operation than conventional mechanical switches. It is feasible to operate this switch at a higher speed than 10 kHz.

(4) A piezoelectric actuator or an electrostatic actuator has a narrow range of reciprocation. An enough wide area of conductive portions can be obtained by increasing the number of the conductive stripes and decreasing the width of the conductive stripes. For example, a width of less than 1 mm of conductive stripes and insulating stripes enables a piezoelectric actuator and an electrostatic actuator to drive the sliding plates.

(5) In the case of diamond sliding plates, the sliding plates are excellent in lubricancy and abrasion-resistance.

(6) Diamond has inherently a high resistivity but can be converted into a conductive material by doping impurity.

Since both the insulating parts and the conductive portions are made of the same material, there is no discontinuity of the hardness, heat expansion coefficient, friction coefficient or so on. Owing to the high heat conductivity, diamond effectively diffuses the heat generated by the actuator and the heat caused by friction.

(7) This is not a semiconductor switch but a sort of mechanical switches. Thus, the on-resistance is very low and the heat generation is low.

(8) The insulation-breakdown of the insulator material is several tens of times or several hundreds of times higher than air. Among conventional insulating materials, diamond has a quite high insulation-breakdown voltage. The insulation-breakdown voltages of air, Si and diamond are shown as follows,

| | insulation-breakdown voltage |
|---|---|
| air | $2 \times 10^4$ V/cm |
| silicon (Si) | $3 \times 10^5$ V/cm |
| diamond (C) | $1 \times 10^7$ V/cm |

Namely, this invention adopts a micro-mechanical sliding switch for controlling big electric power. In particular, this invention can give a switch capable of turning on or turning off a big current at an instance by a microscopic movement.

Conventional big mechanical switches can treat several megavolts (MV). But the response is quite slow. Conventional semiconductor switches are endowed with a high speed response, but are incompetent for dealing with a big current. This invention can turn on or turn off as big a current as conventional mechanical switches at a speed comparable to conventional semiconductor switches.

BRIEF DESCRIPTION OF THE DRAWINGS

FIG. 3(2) shows the step of growing an undoped diamond film on the substrate.

FIG. 3(3) shows the step of cutting grooves in parallel in the undoped diamond film by a laser or by RIE (reactive ion etching).

FIG. 3(4) shows the step of growing a boron-doped diamond film in the grooves and on the undoped diamond film.

FIG. 3(5) shows the step of eliminating an extra boron-doped diamond film on the undercoat diamond by polishing.

FIG. 3(6) shows the steps of overlapping two equivalent sliding plates face to face and installing a driving device being based upon one of the sliding plates and being in contact with the side of the other sliding plate.

FIG. 5(2) shows the steps of painting a photoresist on the molybdenum substrate and patterning the resist for making a parallel stripe mask.

FIG. 5(3) shows the steps of etching the molybdenum substrate through the stripe mask by acid, making grooves and ridges in parallel in the substrate, and removing the resist from the ridges.

FIG. 5(4) shows the step of depositing an $SiO_2$ film on the ridges, the grooves and the other parts of the substrate.

FIG. 5(5) shows the step of eliminating extra $SiO_2$ from the substrate by polishing.

FIG. 5(6) shows the steps of overlapping two equivalent sliding plates face to face, and installing a driving device upon one of the sliding plates in contact with the side of the other sliding plate.

DETAILED DESCRIPTION OF THE PREFERRED EMBODIMENTS

Figure 1:
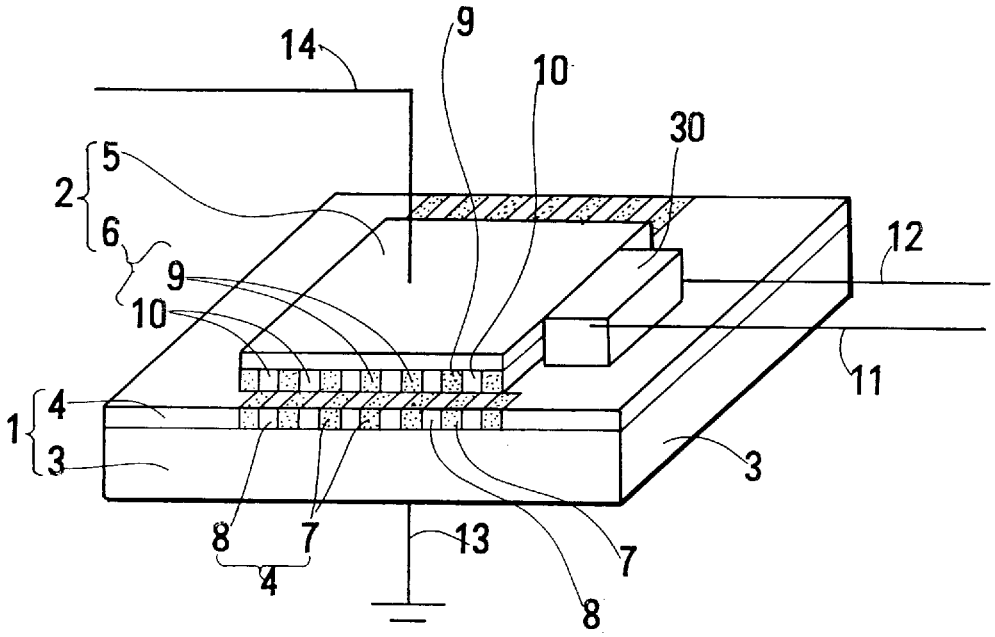
FIG. 1 is a perspective view of an electromechanical switch as an embodiment of the present invention.

A sliding plate contains periodically-distributed conductive parts and an insulating background. Homogeneous type of sliding plate includes conductive parts and insulating parts made of the same material. Heterogeneous type of sliding plate contains conductive parts and insulating parts made of different materials. In this case, both materials must be superior in smoothness and abrasive-resistance.

Homogeneous type can enjoy an advantage of a small spatial period T realized by narrowing the sizes of the conduction parts and the insulating background. The smallness of the period T enables the driving device to shorten the time for displacement, and enables the sliding plates to reduce the abrasion. Diamond is a suitable material for the homogeneous type of sliding surface, since undoped diamond is insulating, but boron-doped diamond is conductive. Further, diamond excels in smoothness, hardness, heat conductivity, abrasive-resistance and chemical-resistance.

Heterogeneous type has different materials for the conductive parts and the insulating parts (background). The conductive parts can be built with a metal, for example, molybdenum (Mo), chromium (Cr), nickel (Ni), silver (Ag) and so forth. The insulating background can be made of silicon dioxide ($SiO_2$), silicon nitride (SiN), alumina ($Al_2O_3$), aluminum nitride (AlN), boron nitride (BN), titanium nitride (TiN), titanium dioxide ($TiO_2$) and so on.

Regarding the periodicity, one-dimensional periodicity is realized by the stripe/stripe structure. Two-dimensional periodicity is accomplished by the dot/background (or island/sea) structure. In the case of the stripe/stripe structure, the conductive parts are parallel bands (stripes) intervened by parallel insulating bands (background). A conductive band or an insulating band may take a width D or Z of several millimeters. Preferably, the widths should be less than 1 mm for the sake of quick response of the switch. It is feasible to fabricate the stripe/stripe structure of widths less than 1 mm on a metal substrate by digging a plurality of narrow grooves on the metal and filling the grooves with an insulating material. Alternatively, it is also facile to produce the stripe/stripe structure of widths less than 1 mm on an insulator by cutting grooves on the insulator and filling the grooves with a metal.

The above method is applicable to the homogeneous type of, e.g., diamond sliding plate composed of undoped insulating diamond and boron-doped insulating diamond. However, there is a far preferable method for the homogeneous type which makes a sliding plate by depositing overall undoped diamond on a metal substrate, and doping impurity in stripes on the diamond for converting the insulating diamond to conductive diamond. Such a selective doping method can reduce the widths D and Z to about 1 micrometer ($\mu$m). Inequality $D<Z$ is always required for D and Z. The smaller D and Z become, the faster the switching device acts. The larger D and Z become, the higher the allowable off-voltage enhances. Suitable widths D and Z are 1 micrometer to 1 millimeter for reconciling the requirements of the high off-voltage and the quick response. However, D and Z wider than 1 mm are available for enhancing the off-voltage farther higher. In this case, the switch of the invention is still superior in suppressing an arc to conventional mechanical switches.

In the case of two-dimensional periodicity (island/sea structure), the conductive parts are plenty of small squares, rectangles, triangles, rounds, ellipses or so on, which are dispersed periodically both in the x-direction and in the y-direction defined on the sliding plate. The conductive dots are periodically distributed on the background like islands floating on a sea. The direction of the relative motion of the sliding plates is either the x-direction or the y-direction. For example, a conductive part can be a rectangle of P×Q. When the sliding plates are displaced in parallel to the side P, the spatial period T must satisfy an inequality $2P<T$. If the conductive part is a round of a radius R, the spatial period T is restricted by another inequality of $4R<T$.

The sliding plates have been clarified about the material, the periodicity and the fabrication. The switch includes current assembling members and a driving device. Since the conductive parts are isolated by the insulating background, all the conductive parts must be unified into one conductive member. The device which unifies all the conductive parts is the current assembling member. The current assembling member is formed, e.g., by making the whole back of the sliding plate with a metal. Otherwise, a current assembling member can be produced by making only the middle part of the back of the sliding plate with a metal.

The driving device moves relatively two sliding plates in the direction parallel to the surfaces. The driving device can be mechanically built with a motor, a reduction gear and a crank device of converting rotation to reciprocation. Alternatively, another driving device can be assembled by, e.g., a solenoid which moves a plunger by electromagnetic force. Piezoelectric actuator is also available for making a driving device which is suitable for reciprocating in a small stroke (half of a period).

In particular, for microscopic displacement, the piezoelectric device is pertinent for the driving device which slides the sliding plates on the counterparts. Piling a plurality of piezoelectric materials gives a stroke of several tens of micrometers to the piezoelectric device. In the case of the stripe/stripe structure, the stroke L must satisfy an inequality $D<L<Z$. Thus, a piezoelectric device or an electrostatic device is applicable to the driving device in the case of a stroke of micrometers.

[EMBODIMENT 1]

Figure 2:
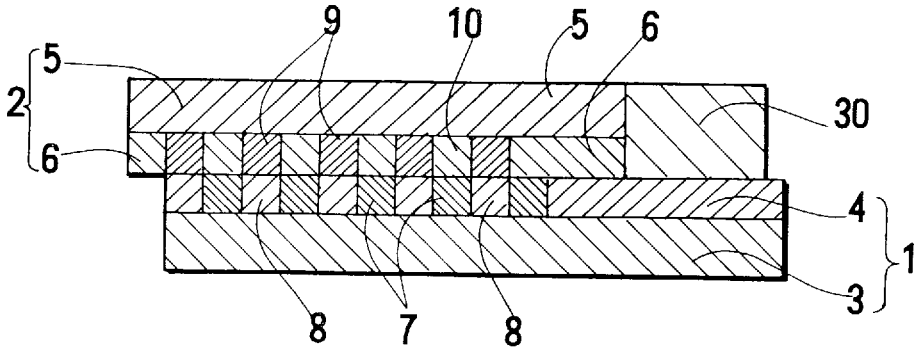
FIG. 2 is a sectional view of a pair of sliding plates overlapped face to face in the off-state of the electromechanical switch of an embodiment.

FIG. 1 shows a perspective, schematic view of an electromechanical switch of an embodiment of the present invention. FIG. 2 shows a sectional view of a pair of sliding plates. A first sliding plate (1) is in contact with a second sliding plate (2) face to face. The first sliding plate (1) consists of a conductive substrate (3) and a diamond contacting layer (4) formed on the conductive substrate (3). The second sliding plate (2) consists of a conductive substrate (5) and a diamond contacting layer (6) deposited upon the conductive substrate (5). A driving device (30) is mounted on the first sliding plate (1) for moving the second sliding plate (2) in the direction parallel with the surfaces relatively to the first sliding plate (1). In the example, the bottom of the driving device (30) is fixed to the top surface of the first sliding plate (1) and a side of the driving device (30) is affixed to the second sliding plate (2). The driving device (30) can reciprocate in the direction parallel to the surfaces.

In the embodiment, the contacting layers (4) and (6) are made of diamond. The whole of the layers (4) and (6) are diamond but are not fully homogeneous in conductivity. Conductive parts (7) and (9) are formed in parallel stripes on the diamond layers (4) and (6). The rest of the diamond layers are insulating stripes (8) and (10) which play the role of the insulating background for separating neighboring conductive stripes spatially. The conductive stripes are formed by doping an impurity in stripes on the diamond layer. The conductive substrates (3) and (5) are made from a metal, e.g. molybdenum (Mo), nickel (Ni), copper (Cu), silicon (Si) or so on. The conductive substrate (3) is electrically joined with all the conductive parts (7). All the conductive diamond stripes (9) are coupled electrically to the conductive substrate (5). The conductive substrates (5) and (3) act as current assembling members. Leads (11) and (12) are fitted on electrodes of the driving device (30). Application of voltage to the electrodes deforms the driving device (30) in the direction parallel to the surfaces in proportion to the applied voltage. The deformation relatively displaces the sliding plates (1) and (2). Leads (13) and (14) are joined to the conductive substrates (3) and (5) respectively.

There are two stable positions of an on-position and an off-position for the second sliding plate (2) on the first sliding plate (1). At the on-position, the conductive stripes (7) and (9) are in contact with each other, and the insulating stripes (8) and (10) are in contact with each other. In the closed state, a current flows from the lead (13) through the substrate (3), the conductive stripes (7) and (9) and the substrate (5) to the other lead (14) or vice versa.

On the contrary, at the off-position, the conductive stripes (7) are in contact with the counterpart insulating stripes (10) and the conductive stripes (9) are in contact with the corresponding insulating stripes (8). In the open state of the switch, a current is blocked by the insulating backgrounds (8) and (10).

Figure 3:
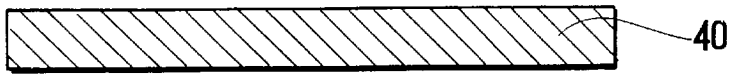
FIG. 3(1) is a sectional view of a molybdenum (Mo) substrate as a starting material for producing a sliding plate of a first embodiment of the present invention.
Figure 3:
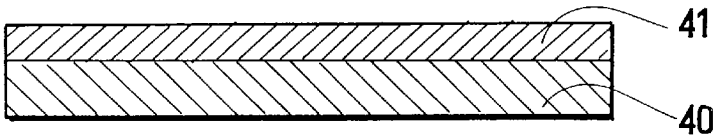
Figure 3:
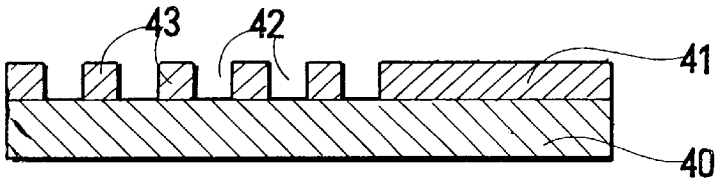
Figure 3:
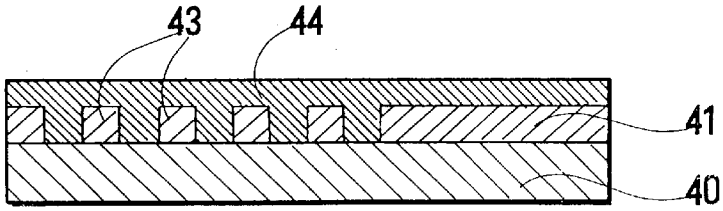
Figure 3:
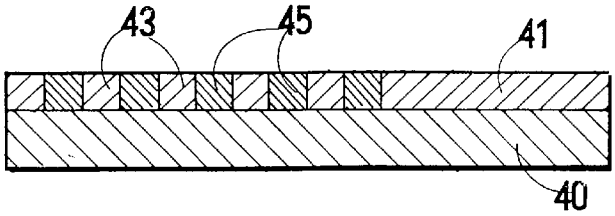
Figure 3:
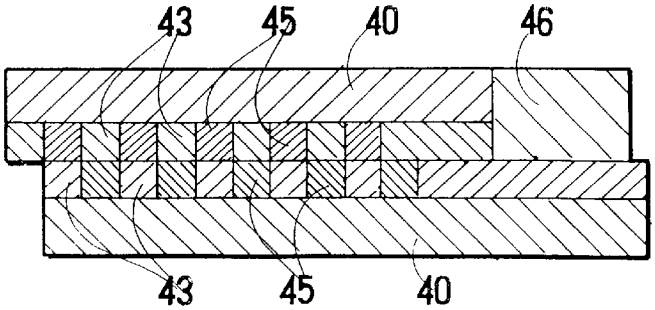

FIG. 3(1) to FIG. 3(6) demonstrate the processes of making the electromechanical switch. FIG. 3(1) shows a starting molybdenum (Mo) substrate of a 2 mm thickness as a conductive substrate. Mo can be replaced by Si, Ni or Cu. A high resistivity diamond layer (41) is formed by a vapor phase synthesis method. Here, a microwave plasma CVD apparatus is adopted for the vapor phase synthesis of diamond.

Figure 4:
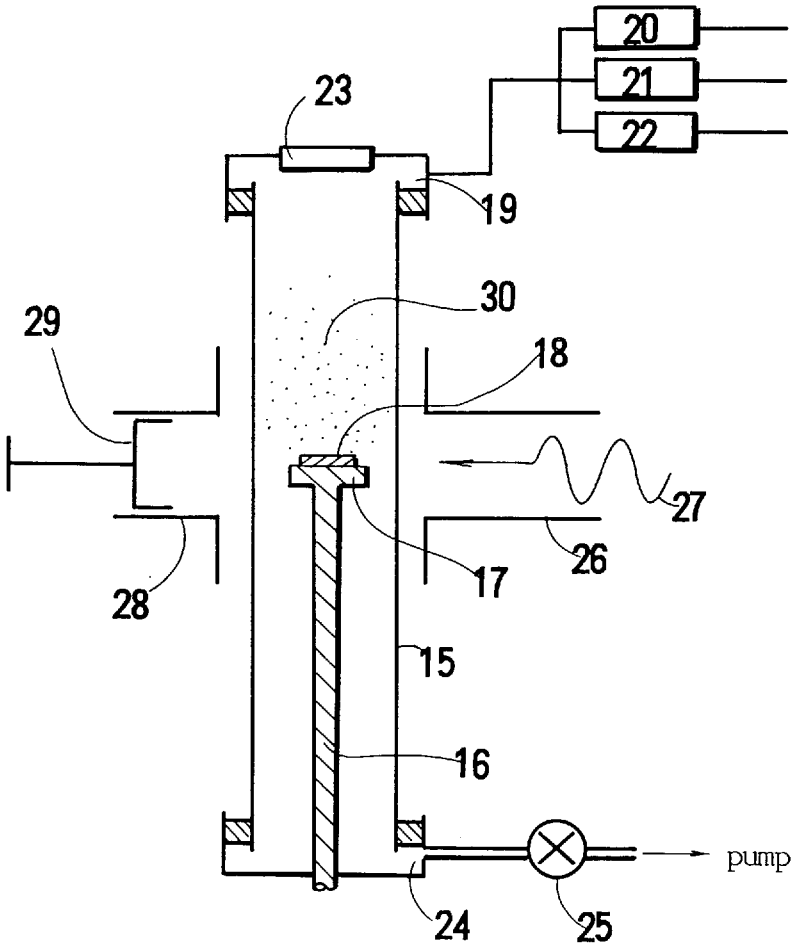
FIG. 4 is a schematic sectional view of a microwave plasma CVD apparatus for making a sliding plate of diamond as a part of an embodiment of the present invention.

FIG. 4 shows a schematic view of the microwave plasma CVD apparatus. A vertically elongate chamber (15) has a shaft (16) for supporting a susceptor (17) on the top. The shaft (16) can rotate, rise and fall. The susceptor (17) sustains a sample (18). The sample is a Mo substrate in the embodiment. The chamber (15) has a gas inlet (19) for inhaling, for example, hydrogen gas, methane gas, diborane gas and so on. Gas flow controlling systems (20), (21) and (22) control the intakes of the hydrogen gas, methane gas and diborane gas, respectively. Insulating diamond is synthesized with hydrogen gas and methane gas.

Besides methane gas, diamond can be produced with other hydrocarbon gases. Diborane emits boron atoms which act as p-impurity in diamond and convert the diamond into p-type conduction by reducing resistivity. The parts which have been converted to p-type become the conductive parts. The rest becomes the insulating backgrounds (8) and (10). The stripes are formed by adopting a mask having a stripe image.

Entering the reaction chamber (15), the material gas flows down through the chamber (15). The exhaustion gas goes out of the chamber (15) through an outlet (24). The gas is exhaled via a valve (25) by a vacuum pump (not shown). Microwave (27) generated by a magnetron (not shown) propagates in a waveguide (26) and goes into the chamber (15) at a point at which the waveguide meets the elongate chamber (15) at a right angle. The microwave is reflected by a plunger (29) which can move in the waveguide (26). Stable microwave can be introduced into the chamber (15) by adjusting the position of the plunger (29) and determining a stationary mode of microwave.

The microwave (27) excites the material gas into plasma (30). The susceptor (17) contains a resistor heater (not shown) for heating the susceptor (17). The sample (Mo substrate) (18) is heated by both the plasma and the inner heater. The plasma and the heat induce the vapor phase reaction of synthesizing diamond on the Mo substrate (18). Exhaustion gas and unreacted gas further flow down in the chamber (15). The gases are exhaled from the outlet (24) by a vacuum pump. The conditions for synthesis are as follows;

| | | |
|---|---|---|
| Substrate | | Si or Mo |
| Material gas | hydrogen ($H_2$) | 200 sccm |
| | methane ($CH_4$) | 6 sccm |
| | carbon dioxide ($CO_2$) | 1 sccm |
| | diborane ($B_2H_6$) diluted at 1000 ppm by $H_2$ | |
| | production of insulating parts | 0 sccm |
| | production of conductive parts | 10 sccm |
| Pressure | | 100 Torr |
| Microwave Power of 2.45 GHz | | 500 W |
| Substrate Temperature | | 1100° C. |
| Time of Synthesis | | 30 hr |

The diamond synthesis process produces a uniformly diamond-coated substrate as shown in FIG. 3(2). The diamond is insulating, because no impurity is doped. Then a plenty of parallel grooves (42) are dug with a constant space in the diamond layer (41) on the substrate (40) by a laser. As shown in FIG. 3(3), diamond stripes (43) remain on the substrate (40). The width of a groove is 100 $\mu$m. Instead of the laser processing, the stripes can be formed by the reactive ion etching (RIE). Selective growth can also produce such a ridge/groove structure in addition to the laser processing or the selective etching.

A highly boron-doped diamond layer (44) is grown on the etched undoped diamond (41) under the conditions which have been described above. The condition is similar to the growth of the insulating diamond except the boron doping. Unlike the production of undoped diamond, diborane gas diluted at 1000 ppm with hydrogen gas is supplied at a ratio of 10 sccm into the reaction chamber (15). The other parameters are the same as the production of the undoped one. FIG. 3(4) shows the sample on which the boron-doped diamond is deposited.

Then, the extra boron-doped diamond covering the undoped diamond is eliminated by polishing till the top of the undoped diamond reveals. FIG. 3(5) exhibits the step after polishing. At the step, undoped diamond stripes (43) and B-doped diamond stripes (45) are formed in parallel by turns on the Mo substrate (40). Two kinds of diamond stripes give a diamond contact layer (4) or (6). The Mo substrates play the role of the current assembling member. A sliding plate is given by a set of the metal substrate and the contact layer.

Two equivalent sliding plates are produced by the above method. A switching portion is produced by bringing two sliding plates into contact with each other face to face and joining a piezoelectric actuator (driving device) (46) on the side of one sliding plate and on the surface of the other sliding plate. FIG. 3(6) shows the step of assembling two plates. Finally, an electromechanical switch is produced by bonding leads on the metal substrate, as shown in FIG. 1.

The switch is tested for searching the properties with regard to a current, an off-voltage and a response. The off-voltage is 5 kV for the embodiment switch. This switch can turn on and turn off 500 A at a frequency of 10 kHz. Any conventional mechanical switch cannot turn on and turn off such a big current of high voltage at such a high speed. The result of the examination exhibits the excellence of the present invention. A 10000 hour operation does not degenerate the performance of the switch yet when the life time is examined.

[COMPARISON EXAMPLE 1]

A comparison example is made on a similar condition to embodiment 1 except the line width. The line width of the conductive stripe is 1 $\mu$m in the comparison example which is a hundredth of the width of the mentioned embodiment (100 $\mu$m). he off-voltage (breakdown voltage) falls to a voltage less than 100 V due to the narrowness of the conductive parts. Too narrow electrodes are undesirable, since the arrow conductive stripes reduce the off-voltage. From the standpoint of the off-voltage, the allowable minimum width of the electrode is 1 $\mu$m.

[COMPARISON EXAMPLE 2]

A further comparison example is made for comparison on a similar condition to embodiment 1 except the line width. The line width of the conductive stripe is more than 1 mm in the comparison example 2 which is ten times as wide as the width of the mentioned embodiment (100 $\mu$m). The off-voltage rises higher than the embodiment mentioned. But the response is degenerated, since the stroke of the slide is wide. An electrode width more than 1 mm requires several kilovolts for a driving actuator due to the long stroke of the sliding plates. Such a broad width of the electrode makes the high speed switching difficult. Thus, line widths from 1 $\mu$m to 1 mm are pertinent for the conduction stripe.

[COMPARISON EXAMPLE 3]

All the examples install the driving device upon the sliding plate. A further example is produced for investigating the effect of mounting the driving device on the plate. This example places the piezoelectric oscillator outside of the sliding plates. The heat generated by the oscillation is not effectively diffused from the piezoelectric actuator (oscillator). In the comparison example 3, a 1000 hour operation of 10 kHz degrades the piezoelectric actuator due to the ineffective heat dissipation. On the contrary, embodiment 1 succeeds in effective heat dissipation since the driving device is tightly fixed on the sliding plate of diamond which excels in heat conductivity. Thus, a 10000 hour driving does not degenerate the switch operation of embodiment 1. The comparison shows the double advantages of diamond which lengthens the life time of the driving device by diffusing the heat of the actuator effectively, and raises the response speed by reducing the friction between the sliding plates.

[EMBODIMENT 2 ($SiO_2$/Mo)]

Figure 5:
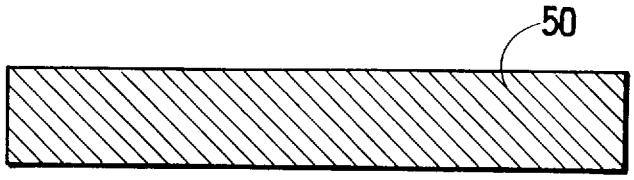
FIG. 5(1) shows a section of a molybdenum substrate as a starting material for making another sliding plate of a second embodiment of the present invention.
Figure 5:
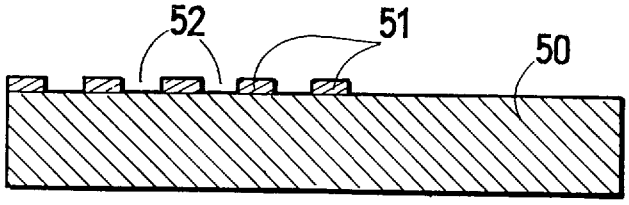
Figure 5:
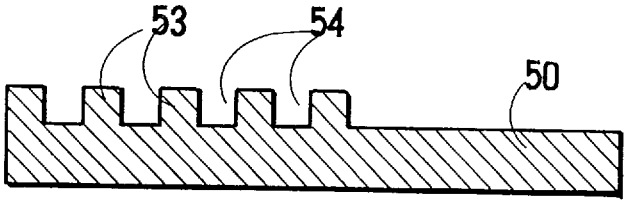
Figure 5:
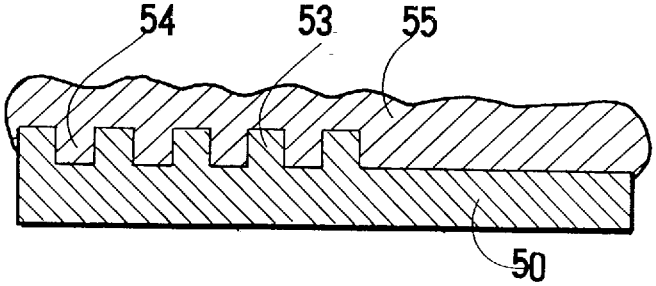
Figure 5:
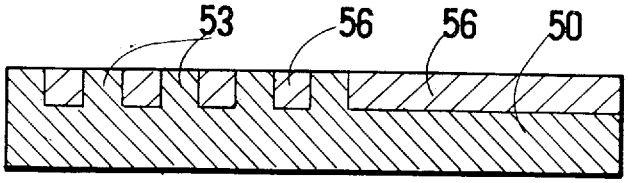
Figure 5:
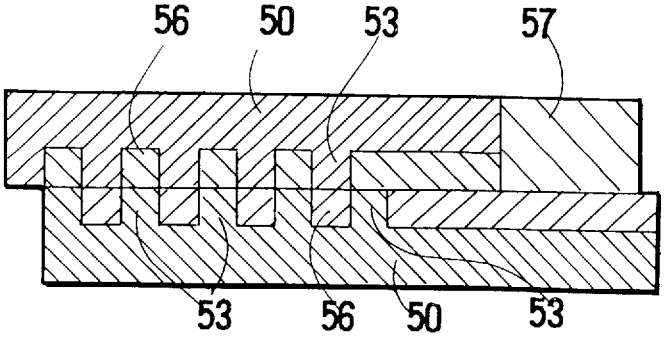

This invention can be realized by assembling a set of different materials of the conduction parts and the insulating parts. An embodiment of the heterogeneous type is explained. A molybdenum substrate (50) of a 2 mm thickness is prepared, as shown in FIG. 5(1). A photoresist pattern for stripes is made by painting a photoresist upon the Mo substrate (50), positioning a mask of a 100 $\mu$m line (51) & space (52) on the resist, exposing the resist through the mask, and developing the resist. There are a plurality of parallel resist stripes (51) and spaces (52) on the substrate (50), as shown in FIG. 5(2). Parallel conductive stripes of Mo are formed by etching the Mo substrate (50) by fluoric acid through the resist and removing the resist. FIG. 5(3) shows the sample at the step. The substrate has many parallel ridges (53), many grooves (54) and a flat portion on a side. The depth of the groove is 150 $\mu$m.

Then $SiO_2$ layer (55) is deposited on the Mo substrate by painting SOG by a spinning method, heating the SOG, and hardening the SOG into a $SiO_2$ layer. FIG. 5(4) shows the $SiO_2$ coated-substrate. The $SiO_2$ rides on the ridges (53) and the grooves (54) at the step. Then, the extra $SiO_2$ is removed by polishing the surface of the sample. FIG. 5(5) shows the polished flat sample. Two equivalent samples are made by the same way.

Then, a switch is produced by fitting two equivalent sliding plates face to face, mounting a piezoelectric driving device (57) on a surface of one plate and on the side of the other plate, and furnishing leads on the Mo substrate (50). This is not a diamond one but a heterogeneous switch including $SiO_2$ and Mo. The conductive parts (53) are built by the Mo substrate itself. The insulating background (56) is made from silicon dioxide $SiO_2$. Different materials are arranged in parallel by turning on the sliding surfaces. Sufficiently even surfaces are obtained by polishing. The friction loss is low enough.

This switch exhibits 4 kilovolts of off-voltage. The switch can turn on and turn off an 800 A current at a speed of 10 kHz. A continual 5000 hour of repetition of on and off does not degenerate the operation as a switch. This is a mechanical switch excellent in both the off-voltage and the speed. This embodiment can produce a good mechanical switch by the simple steps of etching Mo, painting SOG, and polishing without the CVD process which requires a high temperature reaction.

[EMBODIMENT 3 (diamond/Mo)]

In embodiment 3, diamond is deposited on a groove-dug Mo substrate as an insulator instead of the silicon dioxide film ($SiO_2$) in the embodiment 2. Diamond is grown on the ridged Mo substrate as shown in FIG. 5(3) by the microwave plasma CVD apparatus shown in FIG. 4. The condition of the diamond synthesis is the same as the above mentioned process (diborane=0 sccm) of making undoped diamond for embodiment 1. FIG. 5(4) shows the result of the deposition (55) must be deemed as diamond. Then, the sample is flattened by polishing the rugged surface. The Mo ridges become conductive stripes, and the diamond fillers become insulating stripes.

Another mechanical switch is completed by fitting a driving device and bonding leads on the Mo substrates. The embodiment reveals a 5 kilovolt off-voltage. This switch can turn on and turn off an 800 A current at a speed of 10 kilohertzes(kHz). No degradation is induced by an 8000 hour operation. Embodiment 3 is superior to embodiment 2 in the off-voltage and the endurance by adopting diamond as insulating stripes.

[EMBODIMENT 4]

Carbon-containing oil is painted on the surfaces of both sliding plates of embodiment 3 having diamond insulators for enhancing lubricancy. The oil improves the lubricance further. The lubricancy can be raised also by painting silicone oil. In addition to carbon-containing oil and silicone oil, molybdenum disulfide ($MoS_2$) enables the switch to reduce the friction between the sliding plates. It is proved that painting of the lubricants does not raise the on-resistance in the embodiment.

What I claim is:

1. An electromechanical switch comprising:

a first sliding plate having a contact surface, a substrate and conductive and non-conductive portions, the conductive portions being periodically dispersed among the non-conductive portions at the contact surface with a predetermined spatial period, and a current assembling member for gathering currents from the conductive portions of the first sliding plate;

a second sliding plate having a contact surface, a substrate and conductive and non-conductive portions, the conductive portions being periodically dispersed among the non-conductive portions at the contact surface with the same spatial period as the conductive parts of the first sliding plate, and a current assembling member for gathering currents from the conductive portions of the first sliding plate;

the contact surface of the second sliding plate being in contact with the contact surface of the first sliding plate; and a driving device for reciprocating the sliding plates relatively in a direction parallel to the contact surfaces by about a half the spatial period of the conductive portions at the contact surfaces, whereby the switch is closed so that current can flow from one sliding plate to the other when conductive portions at the contact surface of one sliding plate are opposite to conductive portions at the contact surface of the other sliding plate; and the switch is open so that current can not flow from one sliding plate to the other when conductive portions at the contact surface of one sliding plate are opposite non-conductive portions at the contact surface of the other sliding plate.

2. An electromechanical switch as claimed in claim 1, wherein the conductive parts are a plurality of parallel stripes with a width D, the insulating background is a plurality of parallel stripes with a width Z intervening neighboring conductive stripes, and the widths D and Z are less than 1 mm but more than 1 $\mu$m.

3. An electromechanical switch as claimed in either claim 1 , wherein the conductive parts are impurity-doped diamond and the insulating background is undoped diamond.

4. An electromechanical switch as claimed in either claim 2, wherein the conductive parts are impurity-doped diamond and the insulating background is undoped diamond.

5. An electromechanical switch as claimed in claims 1, wherein the driving device is an electrostatic device for moving the sliding plates relatively by electrostatic force or a piezoelectric device for displacing the sliding plates relatively by piezoelectric force.

6. An electromechanical switch as claimed in claims 2, wherein the driving device is an electrostatic device for moving the sliding plates relatively by electrostatic force or a piezoelectric device for displacing the sliding plates relatively by piezoelectric force.

7. An electromechanical switch as claimed in claims 3, wherein the driving device is an electrostatic device for moving the sliding plates relatively by electrostatic force or a piezoelectric device for displacing the sliding plates relatively by piezoelectric force.

8. An electromechanical switch as claimed in claims 4, wherein the driving device is an electrostatic device for moving the sliding plates relatively by electrostatic force or a piezoelectric device for displacing the sliding plates relatively by piezoelectric force.

9. An electromechanical switch as claimed in claim 3, wherein the diamond of the conductive parts and the diamond of the insulating background are produced by a vapor phase synthesis method.

10. An electromechanical switch as claimed in claim 4, wherein the diamond of the conductive parts and the diamond of the insulating background are produced by a vapor phase synthesis method.

11. An electromechanical switch as claimed in claim 1, wherein the sliding plates are painted with carbon-containing oil, silicone-containing oil or $MoS_2$ as a lubricant.

12. An electromechanical switch as claimed in claim 5, wherein the driving device is a piezoelectric device produced by piling PZT films.

13. An electromechanical switch as claimed in claim 6, wherein the driving device is a piezoelectric device produced by piling PZT films.

14. An electromechanical switch as claimed in claim 7, wherein the driving device is a piezoelectric device produced by piling PZT films.

15. An electromechanical switch as claimed in claim 8, wherein the driving device is a piezoelectric device produced by piling PZT films.

16. An electromechanical switch as claimed in claim 1, wherein the driving device is mounted on a material of a high heat conductivity.

17. An electromechanical switch as claimed in claim 16, wherein the material of a high heat conductivity is diamond or aluminum nitride.

* * * * *